US005433061A

United States Patent [19]

Hutchinson et al.

[11] Patent Number: 5,433,061

[45] Date of Patent: Jul. 18, 1995

[54] AIR REMOVAL APPARATUS

[75] Inventors: Gary D. Hutchinson, Narrandera; George T. Ollerenshaw, Leeton, both of Australia

[73] Assignee: Ricegrowers' Co-Operative Limited, New South Wales, Australia

[21] Appl. No.: 153,479

[22] Filed: Nov. 16, 1993

Related U.S. Application Data

[63] Continuation of Ser. No. 893,529, Jun. 4, 1992, abandoned.

[30] Foreign Application Priority Data

Jun. 6, 1991 [AU] Australia ..... PK6566

[51] Int. Cl.[6] ..... B65B 31/00; B65B 1/22; B65B 1/24; B65B 61/02

[52] U.S. Cl. ..... 53/415; 53/416; 53/434; 53/436; 53/437; 53/512; 53/525; 53/526; 53/136.5

[58] Field of Search ..... 53/79, 136.5, 415, 416, 53/434, 436, 437, 405, 480, 512, 525, 526, 527, 544, 375.4, 498, 446, 492, 384.1

[56] References Cited

U.S. PATENT DOCUMENTS

| | | | |
|---|---|---|---|
| 2,863,266 | 12/1958 | Moore . | |
| 2,888,788 | 6/1959 | Gebhardt . | |
| 2,916,059 | 12/1959 | Wong | 53/512 X |
| 3,114,994 | 12/1963 | Joa | 53/375.4 |
| 3,245,200 | 4/1966 | Shaw | 53/512 |
| 3,316,103 | 4/1967 | Scopelite et al. | 53/446 |
| 3,321,889 | 5/1967 | Zubik et al. . | |
| 3,469,364 | 9/1969 | Bischoff | 53/434 X |
| 3,471,990 | 10/1969 | Bonuchi et al. . | |
| 3,581,876 | 6/1971 | Keith | 53/526 X |
| 3,716,961 | 2/1973 | Cope et al. . | |
| 3,748,797 | 7/1973 | Deines | 53/525 X |
| 3,877,197 | 4/1975 | Cayton et al. . | |
| 3,958,391 | 5/1976 | Kujubu | 53/512 X |
| 4,016,707 | 4/1977 | Puchosic . | |
| 4,189,897 | 2/1980 | Ailey et al. . | |
| 4,581,764 | 4/1986 | Plock et al. | 53/512 X |
| 4,920,726 | 5/1990 | Yamada et al. | 53/512 X |
| 4,922,688 | 5/1990 | Langen et al. | 53/525 |
| 4,971,119 | 11/1990 | Combrink et al. . | |

FOREIGN PATENT DOCUMENTS

| | | |
|---|---|---|
| 0167688 | 1/1986 | European Pat. Off. . |
| 0298227 | 1/1989 | European Pat. Off. . |

*Primary Examiner*—Linda B. Johnson
*Attorney, Agent, or Firm*—Jones, Tullar & Cooper

[57] ABSTRACT

Apparatus (1) for removing excess air from sealed packages so as to prevent ballooning. The apparatus (1) comprises a first conveyor belt (3) along which the packages move through the apparatus (1). The conveyor (3) Is driven by two rollers (4 and 5) and is also arranged to vibrate, by means of vibrator (2), in order to settle the contents, e.g. rice, in the packages throughout the operation. When a package is in a predetermined position, as determined by a sensor, such as a photoelectric cell (7), the package is punctured by a suitable device such as a spike (8). As the package continues down the conveyor (3), excess air is removed from the package by means of a spring loaded conveyor (19) which is biased against the package. As spring loaded conveyor (19) is pressed against the package, air in the package Is forced out through the hole made by spike (8). Once the excess air in the package is removed, the package reaches a position where a sticker is placed over the hole in the package by a sticker applicator (18), which can be of any known type.

20 Claims, 3 Drawing Sheets

AIR REMOVAL APPARATUS

This is a continuation of application(s) Ser. No. 07/893,529 filed on Jun. 4, 1991 now abandoned.

BACKGROUND OF THE INVENTION

This invention relates to a method of removing excess air from packages and to apparatus for carrying out the method.

When packages of loose material, such as rice, are sealed, the air remaining in the package will cause the package to balloon, for example due to air expansion in higher temperatures. Ballooning causes problems with downstream packaging equipment designed to place the packages into shipping containers and it also causes pallet stacks to become unstable. In order to prevent ballooning, it is known to puncture the packages at the time of sealing to allow the air to escape. However, this has the disadvantage that the holes allow direct insect ingress or allow insects to lay their eggs inside the packages causing infestation at a later date. This is clearly unacceptable. Most attempts to prevent ballooning by expelling air from the package prior to sealing have been unsuccessful.

BRIEF SUMMARY OF THE INVENTION

It is therefore an object of the present invention to allow air to be removed from sealed packages whilst preventing insects from entering.

According to a first aspect of the present invention there is provided a method of removing excess air from a generally closed package, each package having a hole, comprising the steps of removing excess air from the package, and sealing the hole in the package.

In a preferred embodiment, the package is filled and sealed and then punctured to produce the hole. The package is preferably squeezed to expel the air.

Preferably, the contents of the package are compacted prior to the puncturing step. The compacting step may include any one or more of vibration, agitation and eccentric mechanical action. In a preferred embodiment, the step of sealing the hole comprises providing a sealing element over the hole. Preferably, the sealing step comprises positioning a sticker on the package in the area of the hole and contacting the sticker to the package around the hole so as to seal the hole. The method according to the invention can easily be adapted to a continuous production line. The packages can contain loose foodstuff, such as rice, but could also contain other material which is sealed in an air-tight manner.

According to a second aspect of the present invention, there is provided apparatus for removing air from a sealed package comprising means for expelling air from the package through a hole, and means for sealing the hole.

Preferably, the apparatus further comprises means for puncturing the sealed package to form the hole, In a preferred embodiment, the means for sealing the hole comprises means for positioning a sticker over the package adjacent the hole and means for contacting the sticker to the package around the hole so as to seal the hole. Preferably, the apparatus further comprises means for settling the contents of the package before the package is punctured. The means for expelling air preferably comprises vibratory means for vibrating the package to expel air therefrom, In one embodiment, the apparatus Is arranged to remove air from sealed packages in a continuous production line and comprises a first conveyor belt for transporting the sealed packages, means for puncturing a package on the first conveyor to produce a hole at a predetermined position, a second conveyor biased towards the first conveyor and arranged to vibrate against the package on the first conveyor to expel air therefrom through the hole, and means for sealing the hole.

Preferably, the apparatus also comprises settling rollers arranged upstream of the first conveyor to settle the contents of the package prior to puncturing, The apparatus preferably also comprises means, such as one or more pegs, to arrange the packages to lie In a predetermined orientation on the first conveyor, whereby different size packages can be accommodated by the apparatus. In a preferred embodiment, sensors are provided to sense the position of a package on the first conveyor to indicate when a package is at a position for puncturing and at a position for sealing.

BRIEF DESCRIPTION OF THE DRAWINGS

One embodiment of an apparatus for removing air from sealed packages will now be more fully described, by way of example, with reference to the drawings of which.

DETAILED DESCRIPTION OF THE DRAWINGS

Figure 1:
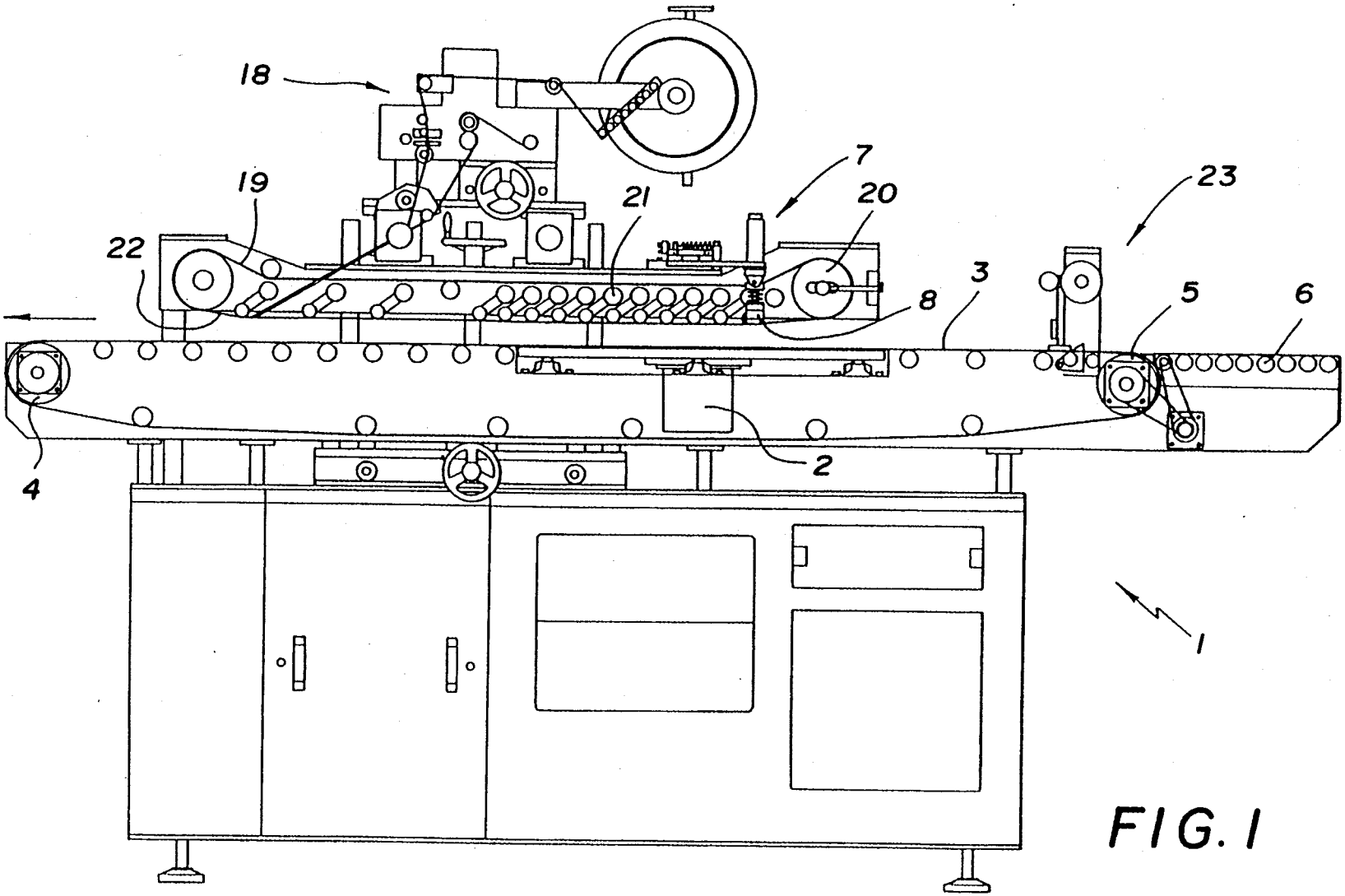
FIG. 1 is a schematic front elevational view of apparatus according to one aspect of the invention.

Thus, FIG. 1 shows a front elevational view of an apparatus 1 for removing excess air from sealed packages so as to prevent ballooning. The apparatus 1 comprises a first conveyor belt 3 along which the packages move through the apparatus 1. The conveyor 3 is driven by two rollers 4 and 5 and is also arranged to vibrate, by means of vibrator 2, in order to settle the rice in the packages throughout the operation. Settling rollers 6 are also provided upstream of conveyor 3 in order to substantially settle the rice before the air removal operation begins.

Figure 2:
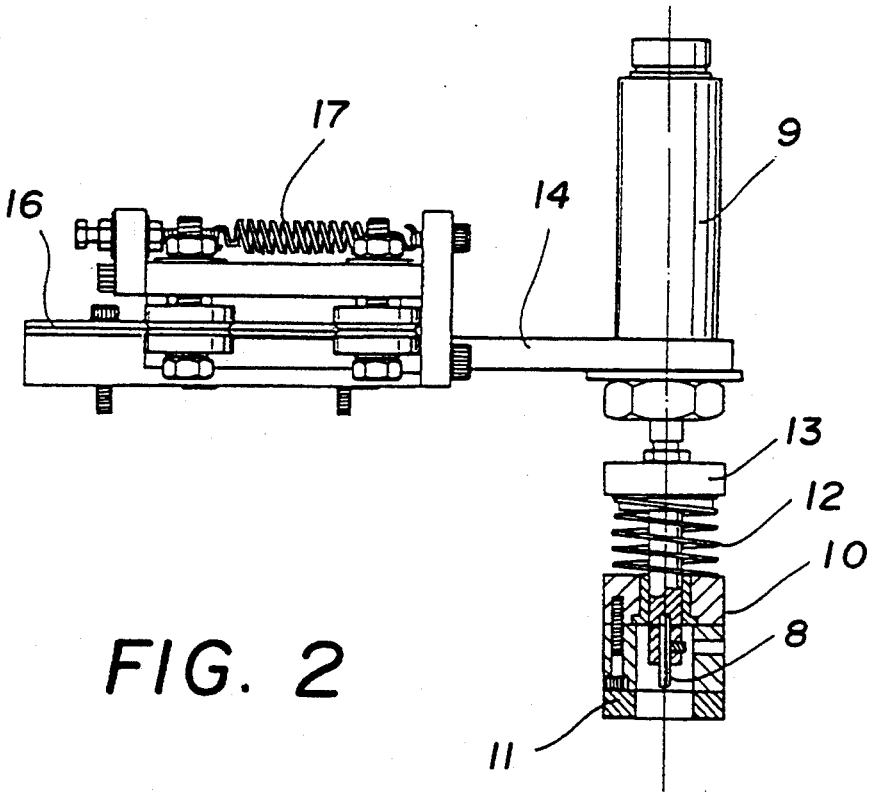
FIG. 2 is a front elevational view of a punch assembly used in the apparatus of FIG. 1.
Figure 3:
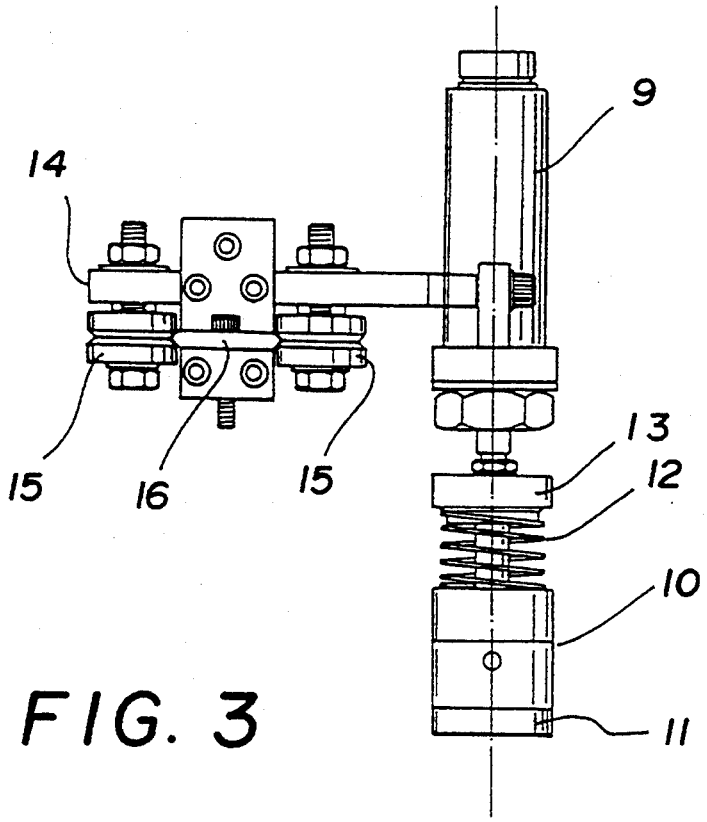
FIG. 3 is a side elevational view of the punch assembly of FIG. 2.

When a package is in a predetermined position at a hole punch station 7, the package Is punctured by a suitable device such as a spike 8. As best seen in FIGS. 2 and 3, the punch assembly 7 comprises a pneumatic cylinder 9 arranged to drive the spike 8 through the surface of the package. The pneumatic cylinder 9 is activated by a sensor, not shown, such as a photoelectric cell, which senses that a package is in the correct position below the spike 8. The spike 8 is mounted on a member 13 connected to the pneumatic cylinder 9 and Is arranged so as to be movable within a plunger 10 connected to the pneumatic cylinder 9 via a biasing spring 12 mounted on a washer 13. On an end face of the plunger 10 there is provided a friction ring 11 which, when it comes into contact with the package, causes the pneumatic cylinder, plunger and spike assembly to move with the package at the same rate while the spike is penetrating the package to prevent the packaging material being ripped.

Thus, when the pneumatic cylinder is first activated, the plunger 10, with the friction ring 11 moves downwards until the friction ring 11 comes into contact with the package. The punch assembly then moves with the package while the punching operation continues. Once the friction ring has come into contact with the packasge, as the pneumatic cylinder moves further downwardly, the plunger 10 and friction ring 11 are biased downwards by the action of spring 12, and the spike 8 then moves downwards through the aperture in the plunger 10 and friction ring 11 to puncture the package. The hole produced by the spike is generally no more than 3 mm in diameter. After puncturing, the reverse process takes place where the spike 8 is first withdrawn within the plunger 10 as the pneumatic cylinder moves upwardly, and then the bias of spring 12 is released before the friction ring 11 is removed from contact with the package.

The pneumatic cylinder 9 is mounted on a bracket 14 having a pair of followers 15 mounted thereon, which cooperate with a linear slide 16 to guide the movement of the pneumatic cylinder 9. When the friction ring 11 is in contact with the package moving on the conveyor 3, the pneumatic cylinder moves with the package on the bracket 14 with the followers cooperating with the linear slide 16. A spring 17 is provided adjacent the linear slide, against which the movement occurs, so that when the friction ring is no longer in contact with the package, the bias of the spring 17 moves the bracket 14 and pneumatic cylinder 9 back to the original position for the next package.

Furthermore, the spike should be arranged so that no dislodged packaging material is injected loose into the package. As the package continues down the conveyor 3, excess air is removed from the package by means of a spring loaded conveyor 19 which is biased against the package.

The spring loaded conveyor 19 is driven by rollers 20 and includes eccentric spring loaded rollers 21 biasing the conveyor belt 22 against the package resting on conveyor 3. The speed of the spring loaded conveyor is synchronised with that of the conveyor 3 so that the packages can be held by both conveyors on their top and bottom surfaces as they pass through the machine. The spring loaded conveyor 19 is conveniently split so as to provide access for spike 8 to puncture the package. Clearly, as spring loaded conveyor is pressed against the package, air in the package is forced out through the hole made by spike 8.

Once the excess air in the package is removed, the package reaches a position where a sticker is placed over the hole in the package by a sticker applicator 18, which can be of any known type. As the package passes the applicator 18, it activates a photoelectric sensor which triggers the applicator to apply the sticker. The sticker applicator can be of any conventional type.

The sticker can be any suitable size and shape but is conveniently circular with a maximum diameter of 20 mm. Both the adhesive used and the label forming the sticker should be of materials suitable for direct food contact. Furthermore, the sticker should be such as to reestablish the integrity of the seal, which should be maintained for a minimum of 12 months on the normal handling conditions.

Figure 4:
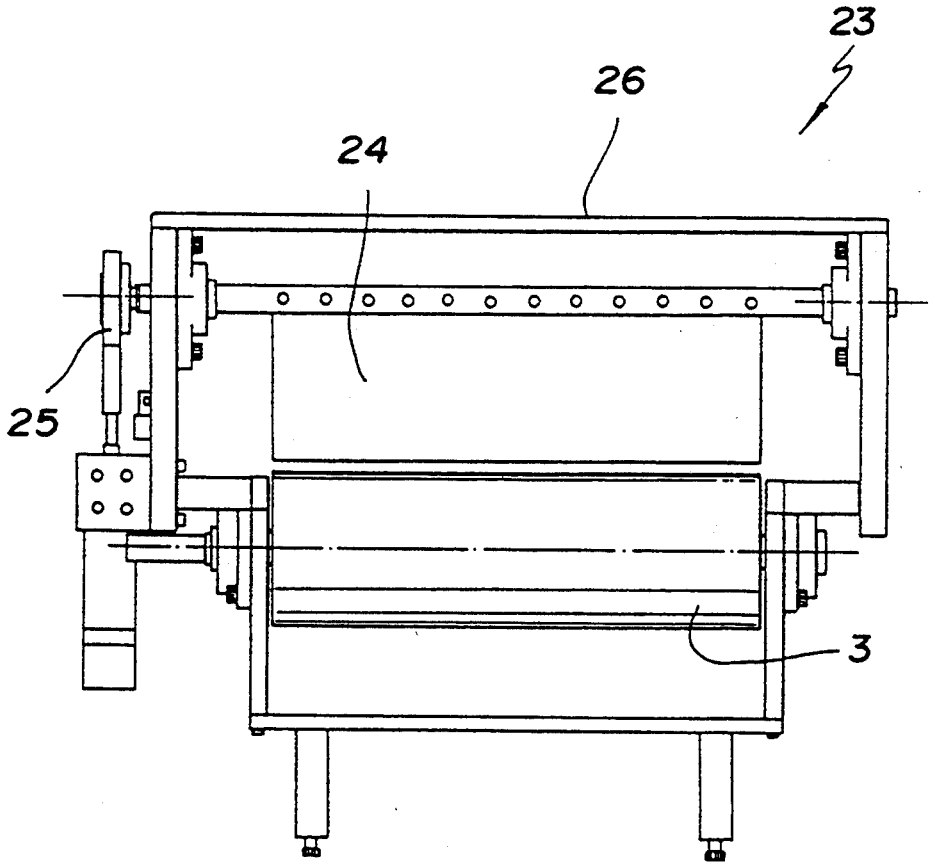
FIG. 4 is a side elevational view of an alignment gate used the apparatus of FIG. 1.

The apparatus 1 Is capable of handling packages of different sizes, e.g. from 0.5 kg to 10 kg packages and the different size packages are conveniently arranged to lie along the conveyor 3 via suitable positioning means, such as an alignment gate 23. The alignment gate 23, as shown in FIG. 4, consists of a flap 24 mounted on a bracket 26 for pivotal movement. The flap Is normally in a vertical orientation. The packages being conveyed collide with the flap 24, straighten against the flap and activate a sensor. After a predetermined delay period, a pneumatic cylinder 25 pivots the flap upwards to allow the straightened package to pass underneath.

There has thus been disclosed a method and apparatus for removing air from sealed packages so as to prevent, or substantially reduce ballooning in such packages. It will be apparent that although one particular embodiment of apparatus has been described in more detail, the invention is not limited to the particular apparatus so described but could utilise any apparatus suitable for carrying out the invention.

What we claim is:

1. A method of removing excess air from a closed package containing a loose, generally flowable substance, said method comprising the steps of:

directing a stream of sealed, closed packages containing a loose generally flowable substance along a path of travel;

locating a plurality of settling rollers along said path of travel of said stream of packages;

passing said stream of packages over said settling rollers;

settling said substance in each of said closed packages during passage of said stream of packages over said settling rollers;

positioning an alignment gate downstream from said settling rollers along said path of travel of said stream of packages;

aligning each of said settled packages received from said settling rollers at said alignment gate;

releasing said settled packages at predetermined timed intervals from said alignment gate;

positioning a hole punch station downstream along said path of travel from said alignment gate, said hole punch station including a punch assembly;

transporting said aligned, settled packages on a first conveyor belt from said alignment gate to said hole punch station;

contacting each of said settled packages with said punch assembly at said hole punch station;

forming a punch hole in a surface of each of said sealed, closed packages being transported on said first conveyor belt at said hole punch station using said punch assembly;

locating a vibrator along said first conveyor belt and vibrating said first conveyor belt;

locating a second conveyor above said first conveyor belt and downstream of said hole punch station, said conveyor and said first conveyor belt cooperating to form a package squeezing station downstream of said hole punch station;

squeezing each of said hole punched packages in said squeezing station to expel said excess air from each of said hole punched packages;

placing a sticker applicator at a sealing station downstream of said squeezing station; and applying a sticker at said sealing station with said sticker applicator and covering said punch hole in each of said squeezed, sealed packages after expelling said excess air from each of said packages in said squeezing station, each said applied sticker sealing each of said squeezed packages from which said excess air has been expelled.

2. An apparatus usable to remove excess air from a closed package formed of an airtight sheet and containing a loose, generally flowable substance, said apparatus comprising:

a plurality of settling rollers adapted to receive a stream of closed packages and to settle a loose, flowable substance contained in each of said closed packages;

an alignment gate positioned downstream, in a direction of travel of said stream of closed packages, from said settling rollers, said alignment gate being operable to align each of said packages and to pass each of said packages from said stream of packages through said alignment gate at predetermined timed intervals;

a puncturing station including a punching device, said puncturing station being located downstream from said alignment gate, said punching device being operable to hole punch each of said closed packages to produce an excess air escape hole in a surface of each of said closed packages;

a first conveyor extending in said direction of travel of said closed packages and receiving each of said packages from said settling rollers and supporting each of said packages for passage through said alignment gate and said puncturing station, said first conveyor including a vibrator usable to vibrate said first conveyor;

a second conveyor overlying and spaced from said first conveyor and extending downstream from said puncturing station, said second conveyor and said first conveyor cooperating to form a package squeezing station downstream, in said direction of travel, from said puncturing station, each of said hole punched packages being squeezed in said package squeezing station to remove excess air through said air escape hole; and a sealing station located downstream, in said direction of travel of said stream of closed packages, from said package squeezing station, said sealing station including a sticker applicator which is operable to apply a sealing sticker to said hole punched surface of each of said closed packages to close said excess air escape hole after said squeezing station has compressed each of said packages to remove excess air from each of said packages.

3. A method according to claim 1, wherein the settling step includes at least one of the operations of vibration and agitation of the substance.

4. A method according to claim 1 wherein the sticker is applied to each of the packages with an adhesive.

5. A method according to claim 1 wherein the hole punching step takes place while each package at the hole punching station is moving.

6. A method according to claim 5 wherein the surface of each of the packages is punctured by a spike, and said method further comprises advancing the spike with and at the same speed as said package at the hole punch station while effecting the hole punching of the package.

7. A method according to claim 6 comprising pressing a friction ring onto each of the packages when at said hole punching station while the package is moving on said first conveyor means, and passing said spike through said friction ring to effect said hole punching of the package.

8. Apparatus according to claim 2, wherein the second conveyor includes a portion arranged to vibrate against the package on the first conveyor means.

9. Apparatus according to claim 2 wherein said alignment gate arranges each package to lie in a predetermined orientation on the first conveyor, whereby different size packages can be accommodated by the apparatus.

10. Apparatus according to claim 9 wherein said gate is arranged above said first conveyor for abutting against each package on the first conveyor and biased against the movement of each package on the first conveyor so that each package is arranged on the first conveyor in a predetermined orientation before moving past the gate.

11. Apparatus according to claim 10 wherein said gate comprises a flap biased by a pneumatic cylinder means against the movement of each package for a predetermined time interval.

12. Apparatus according to claim 11, comprising a sensor that senses when a package has contacted the flap and starts said predetermined time period.

13. Apparatus according to claim 12 further comprising further sensors to sense the position of each package when on the first conveyor and to indicate when each package is at said puncturing station and at said sealing station, said further sensors co-operating to activate said punching device and said sticker applicator.

14. Apparatus according to claim 2 wherein the punching device is constructed to puncture each package while each package is moving.

15. Apparatus according to claim 14, wherein said punching device comprises a spike mounted on a member coupled to a pneumatic cylinder, the member being movable within a hollow plunger which is biased away from the pneumatic cylinder, the hollow plunger having a friction ring on an outer end thereof, such that the friction ring first contacts each package and then, as the pneumatic cylinder is further actuated, the spike, on the member, is moved through the plunger and the friction ring to puncture the package.

16. Apparatus according to claim 15, wherein said punching device further comprises a carriage arranged to travel on a guide track, the pneumatic cylinder being mounted on the carriage so as to travel at the same speed as the package at the puncturing station while the package is being punctured, the carriage being biased back to an initial position when the puncturing operation has been completed.

17. The apparatus of claim 2 wherein said punching device is positioned to puncture only one surface of each package.

18. The apparatus of claim 17 wherein said punching device punctures only an upper surface of each package.

19. The apparatus of claim 2 wherein one of said first and second conveyors is a split conveyor which provides access to each package for said punching device.

20. The apparatus of claim 19 wherein said second conveyor is said split conveyor.

* * * * *